US005656808A

United States Patent [19]

Marche et al.

[11] Patent Number: 5,656,808

[45] Date of Patent: Aug. 12, 1997

[54] METHOD FOR THE USE OF AN X-RAY IMAGE INTENSIFIER TUBE AND CIRCUIT FOR THE IMPLEMENTATION OF THE METHOD

[75] Inventors: Eric Marche, St Egreve; Alain Girard, Le Fontanil; Damien Barjot, St Egreve; Jean-Marie Deon, Grenoble; Yvan Lacoste, Voreppe, all of France

[73] Assignee: Thomson Tubes Electroniques, Velizy, France

[21] Appl. No.: 504,292

[22] Filed: Jul. 19, 1995

[30] Foreign Application Priority Data

Jul. 29, 1994 [FR] France ..... 94 09435

[51] Int. Cl.[6] ..... H01J 31/50

[52] U.S. Cl. ..... 250/214 VT; 313/537; 313/542

[58] Field of Search ..... 250/214 VT, 207; 313/104, 105 R, 105 CM, 523, 524, 528, 527, 529, 530, 531, 532, 533, 534, 535, 536, 537, 540, 541, 542; 348/217; 378/62, 98.8

[56] References Cited

U.S. PATENT DOCUMENTS

| | | | |
|---|---|---|---|
| 3,356,851 | 12/1967 | Carlson . | |
| 4,603,250 | 7/1986 | Contini et al. . | |
| 4,734,573 | 3/1988 | Dill . | |
| 4,839,569 | 6/1989 | Dallin . | |
| 4,872,057 | 10/1989 | Woolfolk | 348/217 |
| 4,882,481 | 11/1989 | Gilligan et al. | 250/214 VT |
| 4,952,793 | 8/1990 | Cantrell et al. . | |
| 5,146,077 | 9/1992 | Caserta et al. | 250/214 VT |
| 5,192,861 | 3/1993 | Breskin et al. | 250/214 VT |
| 5,490,196 | 2/1996 | Rudich et al. | 378/101 |

FOREIGN PATENT DOCUMENTS

| | | |
|---|---|---|
| 0 456 480 A2 | 11/1991 | European Pat. Off. . |
| 2 337 938 | 8/1977 | France . |
| 3136458 A1 | 3/1983 | Germany . |

*Primary Examiner*—Edward P. Westin
*Assistant Examiner*—John R. Lee
*Attorney, Agent, or Firm*—Oblon, Spivak, McClelland, Maier & Neustadt, P.C.

[57] ABSTRACT

Disclosed is a method for the use of an X-ray image amplifier tube comprising a succession of electrodes, among them a photocathode. This X-ray image intensifier tube may have, alternately, an off state and an operating state. The method consists of the application, to the photocathode, of an operating voltage that is a substantially zero voltage when the X-ray image intensifier tube is in an operating state and a positive turning-off voltage greater than the operating voltage so that the X-ray image intensifier tube is in the off state. Application is notably to X-ray image intensifier tubes used in sets that work alternately.

16 Claims, 5 Drawing Sheets

METHOD FOR THE USE OF AN X-RAY IMAGE INTENSIFIER TUBE AND CIRCUIT FOR THE IMPLEMENTATION OF THE METHOD

BACKGROUND OF THE INVENTION

1. Field of the Invention

The present invention relates to X-ray image intensifier tubes notably for medical applications. These X-ray image intensifier tubes are normally used in a sequence or set of units consisting of an X-ray generator, an object to be examined which is most usually a patient, the intensifier tube itself which converts the image of the object given by X photons into an intensified light image and finally a image-taking and image-analysis system generally comprising a photography camera, a motion picture camera, a video camera and an image processing circuit.

2. Description of the Prior Art

In certain applications, notably in cardiology, two sets of instruments of this type are used, positioned at right angles to each other and working alternately. When one system works, the other one does not, for the object is not irradiated by two X-ray beams at the same time. These two sets of instruments enable the obtaining of X-ray images in two directions. When one set is in operation, the X-ray image intensifier tube of the other one must be shuttered or turned off so as not to produce any image. Indeed, the patient produces a large quantity of X-rays by scattering. These X-rays may be picked up by the X-ray image intensifier tube of the inactive set of instruments, and then this tube will produce a poor image.

Generally, the two sets of instruments work alternately at a frequency varying from 30 to 90 Hertz. Each of the generators gives an X-ray pulse having a duration that generally varies from 50 μs to 8 ms. Each X-ray image intensifier tube has to be turned off or on in less than 400 μs or even less if possible.

An X-ray image intensifier tube such as the one of FIG. 1 is formed by a tightly sealed casing 1 comprising an input face 2 that receives an X-ray beam 3 emerging from an object 4 to be examined. The X photons enter by the input face 2 into a primary screen 5 which, from the input face 2 onwards, comprises a scintillator 6, a conductive layer 7 and a photocathode PC. The scintillator 6 converts the X photons into light photons, and these light photons excite the photocathode PC.

The photocathode PC converts light photons into electrons. The conductive layer 7 may be made of indium oxide. The electrons are then extracted, accelerated and focused by a series of electrodes among which there are three successive electrodes G1, G2, G3 followed by an anode A. At the end of their travel, the electrons bombard a secondary screen 8 or an output screen which in turn converts electrons into light photons. An intensified image is formed on the secondary screen 8. It gives a reconstitution, in smaller form, of the image coming from the object 4 to be examined.

All the electrodes have to be supplied with DC current in a stable way. A stabilized supply is necessary (it is not shown in FIG. 1). A single supply with several outputs may be used. The magnitudes of the nominal voltages of each electrode are as follows:

photocathode PC: 0 V electrode G1: 0 V to +350 V electrode G2: +200 V to +2000 V electrode G3: +2 kV to +20 kV anode A: +30 kV The voltage of the electrodes G1, G2, G3 is generally adjustable. This makes it possible to obtain a magnifying-glass effect on a secondary screen. The voltage of the photocathode and the anode A is generally fixed.

In the X-ray image intensifier tubes of recent design such as that of FIG. 1, the sealed casing 1 has a first metal part 11 that includes the front face 2 and forms the electrode G1. The photocathode PC is electrically isolated from this metal part 11 and an insulation beam 9 is provided. The metal part 11 is extended by a glass part 12 to close the casing 1. The other electrodes G2, G3, A go through this glass part. The oldest tubes have an entirely glass casing.

Usually, the operation of turning the X-ray image intensifier tube off is obtained by switching over the voltage of the electrode G1 and/or the electrode G2. Several methods are used at present. One of them consists in switching over the voltage of the electrode G1 to about −700 V while it is between 0 and +350 V when the tube is in operation.

This method cannot be applied to every X-ray image intensifier tube and in every mode. Furthermore, in the case of the X-ray image intensifier tubes where the electrode G1 is a part of the casing, it may be dangerous to take this electrode to a voltage very far from the ground voltage.

Another known method consists in applying a negative voltage of about −1300 V to the electrode G2. The electrode G2 is used to focus the electron beam. During the switch-over operation used to turn on the tube, the electrode G2 must recover an appropriate operating voltage (ranging between +200 V and +2000 V) with a precision of about 3 per thousand to prevent a defocusing of the tube.

The switch-over operation aimed at turning the X-ray image intensifier tube off must be done at high speed and the great difference in potential (between −1300 V and +2000 V) applied to the electrode G2 prompts disturbances, by capacitive coupling, in the voltage of the electrodes in the vicinity especially of the electrode G3. This leads to substantial deterioration in the quality of image.

During the switch-over of the electrode G2 aimed at turning the X-ray image intensifier tube on, the voltage of the electrode G3 increases in forming a peak. Then it decreases slowly to return to its nominal value. The stabilizing of the voltage of the electrode G3 comes into play only after some milliseconds while it is sought to restore the voltage of the electrode G3 to a level substantially below 1 per thousand at the end of 400 μs.

Furthermore, the great difference in potential applied to the electrode G2 during the switch-over operations and the precision of restoration of the voltage at the electrode G2 during a switch-over operation aimed at turning the X-ray image intensifier tube on result in a complex switch-over circuit.

Another known method consists in switching over the electrode voltage G1 and that of the electrode G2 simultaneously. For this purpose, the voltage of the electrode G2 is lowered by about 700 to 1000 V (if it is about 2000 V when the X-ray image intensifier tube is in operation) and the electrode G1 is taken to about −700 V. This method is used to minimize the disturbances in the electrodes near the electrode G2 during a switch-over operation. However, the switching over of two high voltages with high precision of restoration leads to a complicated and expensive switch-over circuit.

The switch-over circuits commonly use either several series-connected bipolar transistors or an oscillator transformer followed by a rectifier.

A circuit with bipolar transistors is complicated to design and therefore expensive.

A circuit with a transformer is limited in terms of switched-over voltage and speed and dissipates a great deal of power. It therefore has low efficiency.

The electrode to be switched over is linked to the switch-over circuit by an armored cable so as to minimize the capacitive coupling with the other electrodes and hence the disturbances in the voltages of the other electrodes that are caused by the switching over. In the variant where two electrodes are switched over simultaneously, two armored cables are needed.

The electrodes that are close to the switched-over electrode and that have their voltage undergo disturbances through capacitive coupling, require a voltage stabilization circuit. Since these electrodes are carried to very high voltages, the stabilization circuits must be sized accordingly. It is possible to use either a large decoupling capacitor or a fast regulation circuit. The capacitor is bulky and dangerous because it stores a great deal of energy. It is well known that it increases the voltage stabilizing time.

The regulation circuit is complicated, costly and difficult to protect against transients. Furthermore, it is bulky.

SUMMARY OF THE INVENTION

The present invention relates to a method for the use of an X-ray image intensifier tube that does not have the above-mentioned drawbacks.

The method according to the invention consists of the application, to the photocathode, of a substantially zero operating voltage when the X-ray image intensifier tube is in a state of operation. According to this method, a positive turning-off voltage is applied to this photocathode, this turning-off voltage being greater than the operating voltage, so that the X-ray image intensifier tube is turned off. A voltage of about +1000 V achieves the turning-off operation.

The method according to the invention may also consist in determining the current in the photocathode by the measurement of a voltage proportional to said current in getting rid of sudden peaks of said current that appear when the voltage of the photocathode is switched over.

These sudden peaks can be absorbed by a capacitor. This determining of the current is valuable for the user especially if he seeks to know the density of X-rays received by the X-ray image intensifier tube.

The method according to the invention may prevent a defocusing of the X-ray image intensifier tube due to the high degree of capacitive coupling between the photocathode and a neighboring electrode. For this purpose, this method consists, when the X-ray image intensifier tube is turned off, in imposing an offset value on the voltage of the electrode that is greater than the nominal value possessed by this voltage when the X-ray image intensifier tube is in the operating state. During the passage from the off state to the operating state, the voltage of the electrodes will automatically resume its nominal value.

For this purpose, the offset value is determined on the basis of the value taken by the voltage of the electrode just after a passage to the off state.

The circuit for the implementation of this method comprises a switching circuit with two MOS transistors mounted in a push-pull mode controlled by optoelectronic means.

It may advantageously comprise a circuit to determine the current in the photocathode.

Provision may be made for a circuit to stabilize the electrode voltage coupled capacitively to the photocathode.

BRIEF DESCRIPTION OF THE DRAWINGS

Other characteristics and advantages of the present invention shall appear from the following detailed description made with reference to the appended drawings, of which.

MORE DETAILED DESCRIPTION

The method of using a X-ray image intensifier tube according to the invention consists of the application to its photocathode of a substantially zero operating voltage when the X-ray image intensifier tube is in a state of operation and in applying a positive turning-off voltage to it that is greater than the operating voltage so that the X-ray image intensifier tube is off.

A voltage of about +1000 V can be used to obtain the turning-off operation.

Figure 2:
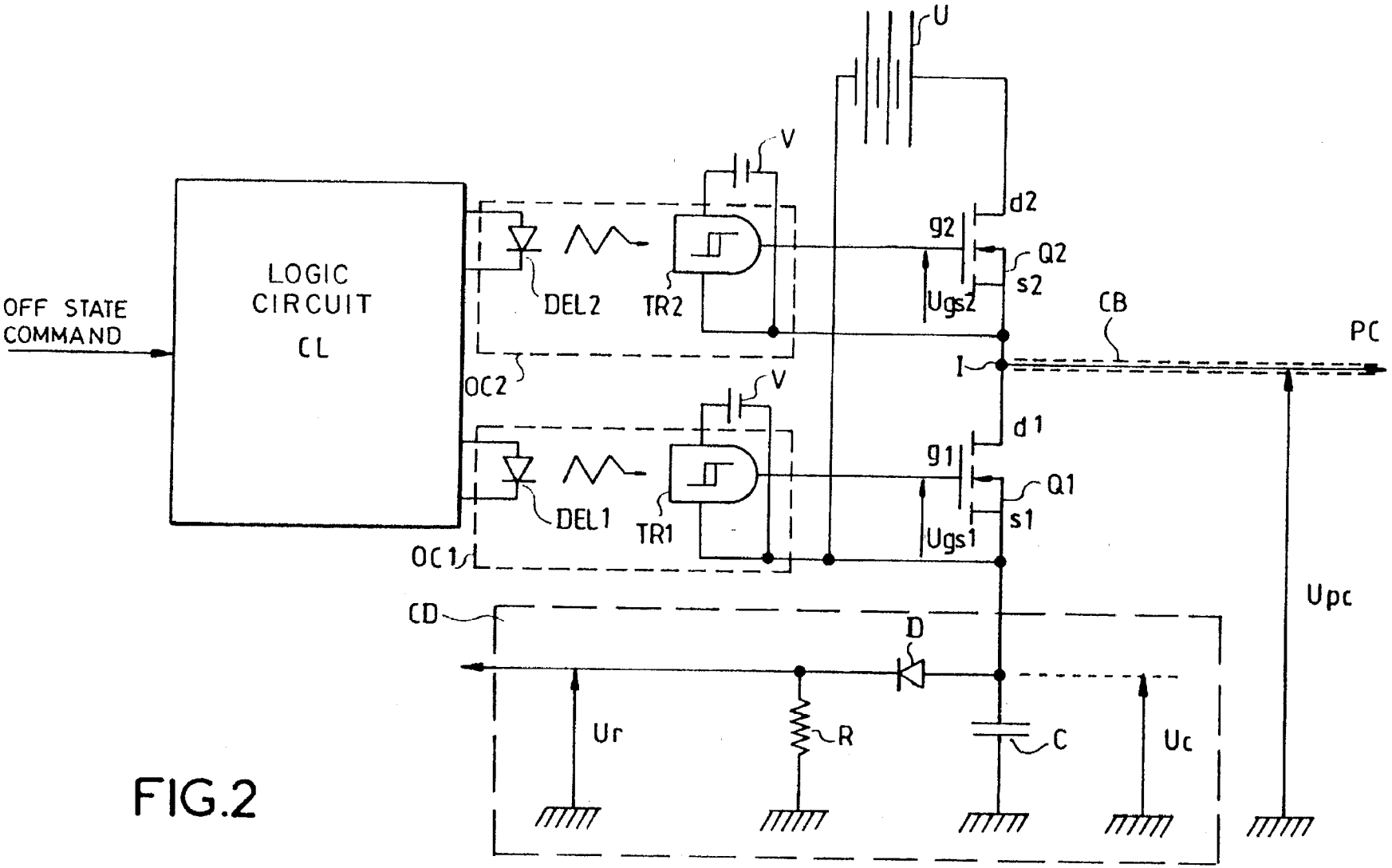
FIG. 2 exemplifies a circuit for the implementation of the method according to the invention comprising a circuit to switch over the voltage of the photocathode and a circuit to determine the current in the photocathode.
Figure 3A:
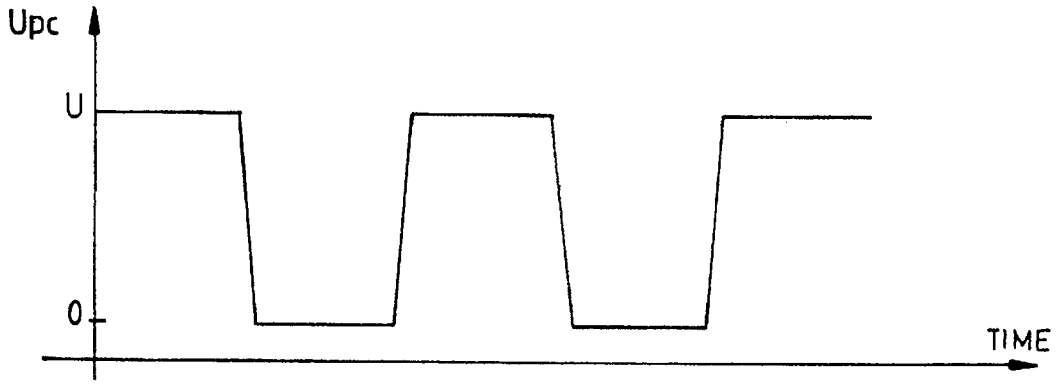
FIGS. 3*a*, 3*b*, 3*c*, 3*d* respectively give a view in time of the voltage of the photocathode, the current in the photocathode, the voltage at the terminal of the capacitor of the determining circuit and the voltage at the terminals of the resistor of the determining circuit.
Figure 3B:
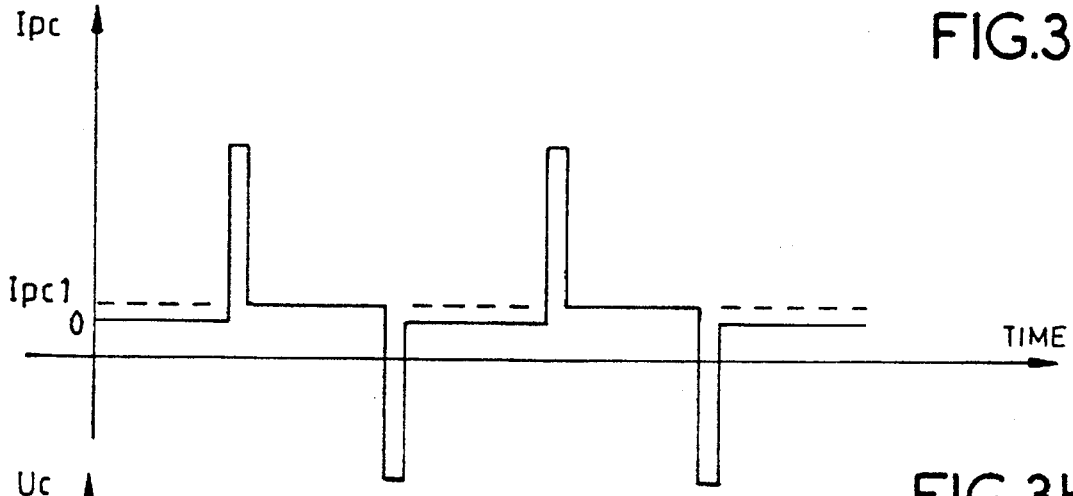
Figure 3C:
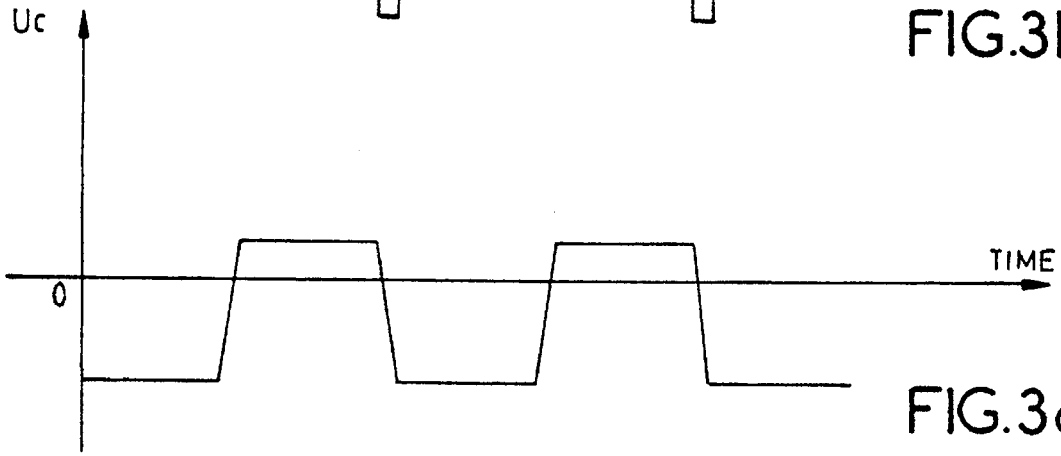
Figure 3D:
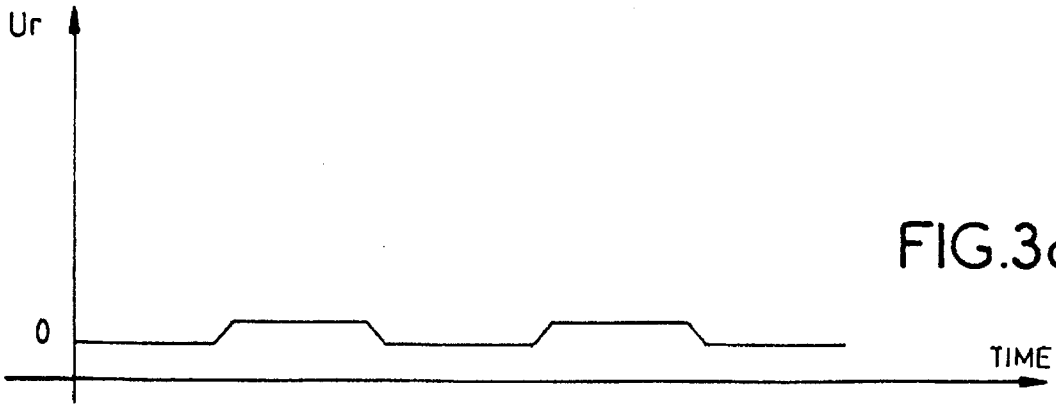

FIG. 2 shows a circuit for the implementation of the method according to the invention. This circuit has a switch-over circuit that uses two high voltage MOS transistors Q1, Q2 mounted in a push-pull mode to switch over the voltage of the photocathode PC. The drain d1 of the first transistor Q1 is connected to the source s2 of the second transistor Q2. The MOS transistors are advantageously N channel type transistors. They are each controlled by an optocoupler OC1, OC2. Each optocoupler has a trigger TR1, TR2 associated with a light-emitting diode DEL1, DEL2. The drain d2 of the second transistor Q2 is connected to the positive terminal of a DC supply U giving the turning-off voltage. For example, this voltage may be 1000 V. The gate g2 of the second transistor Q2 is activated by the trigger TR2 of the second optocoupler OC2 referenced at the source s2 of the second transistor Q2. The drain d1 of the first transistor Q1 is connected to the source s2 of the second transistor Q2. The gate g1 of the first transistor Q1 is activated by the trigger TR1 of the first optocoupler OC1 taking the source s1 of the first transistor Q1 as its reference. The negative terminal of the supply source U is connected to the source s1 of the first transistor Q1. The two triggers TR1 and TR2 are each supplied by a floating supply source V. The optocouplers OC1, OC2 work in all or nothing mode with a threshold effect. They may be made with Schmitt triggers. As soon as a trigger TR1, TR2 is sufficiently illuminated, it becomes conductive. The photocathode PC is connected to the common point I between the source s2 of the second transistor Q2 and the drain d1 of the first transistor Q1.

In order that the X-ray image intensifier tube may be in the off state, a turning-off command is applied to a logic circuit CL which extinguishes the diode DEL1 of the first optocoupler OC1 and illuminates the diode DEL2 of the second optocoupler OC2. It is certain that only one of the MOS transistors is conductive. The illuminated diode DEL2 activates the trigger TR2 and the gate-source voltage Ugs2 of the second transistor Q2 is positive. This saturates the second transistor Q2 and brings the voltage Upc at the photocathode PC to the positive potential of the supply source U, namely +1000 V in the example described. In the meantime, since the light-emitting diode DEL1 of the first optocoupler OC1 is off, the trigger TR1 is deactivated, the gate-source voltage Ugs1 of the first transistor Q1 is zero and the first transistor Q1 is off. When the X-ray image intensifier tube goes into the operating state and comes on, in the absence of the off command, the logic circuit CL activates the extinction of the diode DEL2 of the second optocoupler OC2 and then the illumination of the diode DEL1 of the first optocoupler OC1. The trigger TR2 gets deactivated while the trigger TR1 gets activated. The gate-source voltage Ugs1 of the first transistor Q1 becomes positive and the transistor Q1 is saturated. The gate-source voltage Ugs2 of the second transistor Q2 becomes zero and the second transistor Q2 goes off. The voltage Upc of the photocathode PC is then zero.

Since, when the X-ray image intensifier tube is in the operating state, the voltage Upc of the photocathode PC is substantially zero and when it is in the off state, it is about 1000 V, the switch-over circuit used is simpler, more reliable and faster than previously used circuits which switched over far higher voltages. With such a circuit, high precision of restoration may be obtained, for example a precision of 1 V during the turning-on operation. In the prior art circuits, there was the possibility that instability or imprecision could appear.

Figure 1:
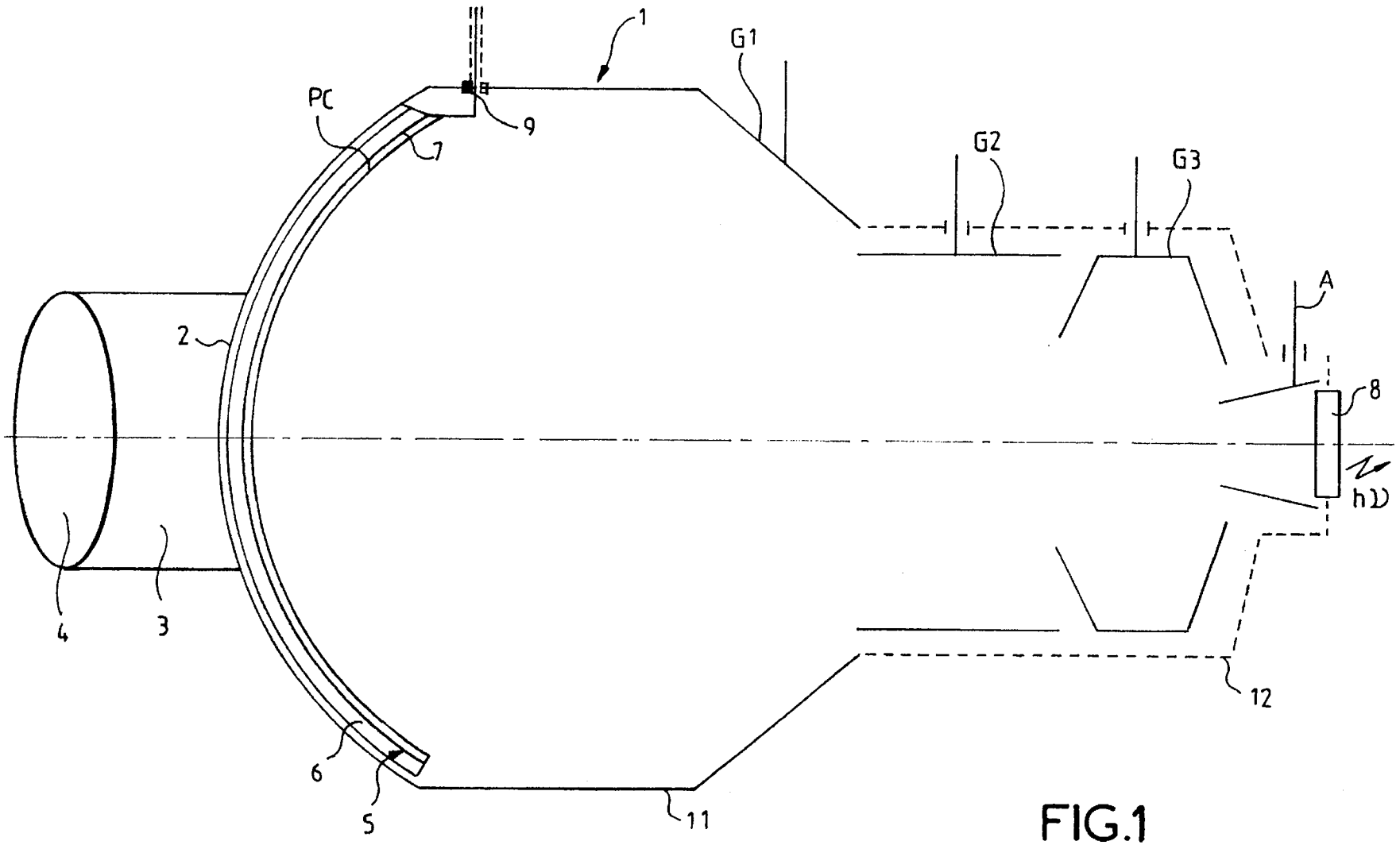
FIG. 1 exemplifies a X-ray image intensifier tube to which the method according to the invention can be applied.

The method of use according to the invention is particularly well suited to a X-ray image intensifier tube such as the one of FIG. 1 with a partially metal casing. The photocathode PC is well insulated within the casing 1. It is then possible to switch over its voltage. It is of course also adapted to older tubes with casings made entirely of glass.

In an X-ray image intensifier tube, the photocathode PC is relatively distant from the electrodes G2, G3 and from the anode A. The capacitive coupling inside the X-ray image intensifier tube between the photocathode PC and these electrodes is negligible.

The disturbances induced by the switching of the voltage of the photocathode PC may be limited by the use of an armored cable to connect the switching circuit to the photocathode. This cable is shown in FIG. 2 with the reference CB.

It may be useful for the user of the X-ray image intensifier tube to determine the value of the current Ipc in the photocathode PC. This may enable it, for example, to quantify the density of X-rays received on the scintillator when the X-ray image intensifier tube is in operation. However, during the switching of the voltage of the photocathode PC, substantial and sudden current peaks Ipc appear in the photocathode PC, making direct measurement difficult. The method of use according to the invention consists in determining this current indirectly in getting rid of major peaks of current. The circuit for the implementation of the method then comprises a determining circuit CD including a capacitor C mounted firstly on the source s1 of the first transistor Q1 and secondly on the ground. This capacitor C absorbs the current peaks that appear during the switch-over operations. This determining circuit CD also uses, in parallel with this capacitor C, a series unit formed by a diode D and a resistor R. The anode of the diode D is connected to the capacitor C and its cathode is connected to the register R.

The method of use consists of the measurement of the voltage Ur at the terminals of the resistor R and this voltage Ur reflects the current Ipc in the photocathode PC outside the times corresponding to the switching over of the voltage of the photocathode and the deactivation of the X-ray image intensifier tube.

FIGS. 3*a*, 3*b*, 3*c*, 3*d* respectively give the following parameters in the course of time: the voltage Upc of the photocathode PC, the current Ipc in the photocathode PC, the voltage Uc at the terminals of the capacitor C and the voltage Ur at the terminals of the resistor R.

The voltage Upc in the photocathode, in the form of squarewaves with relatively steep flanks, is zero when the X-ray image intensifier tube is in the operating state and is equal to the turning-off voltage when the X-ray image intensifier tube is off.

The current Ipc is zero when the voltage Upc is equal to the turning-off voltage and is equal to a value Ipc1 when the tube works and when the voltage Upc is zero. At the time of a passage into an operating state, this current Ipc comprises a positive pulse. At the time of a passage into the off state, it comprises a negative pulse.

When the voltage Upc is equal to the turning-off voltage and when the X-ray image intensifier tube is off, the voltage Uc is negative, the diode D is off and the voltage Ur is zero. When the X-ray image intensifier tube is in the operating state, the voltage Uc is positive, the diode D is conductive and the voltage Ur is such that:

$$Ur = R \cdot Ipc$$

Because of their proximity and their surface area, there is a major capacitive coupling between the photocathode PC and the neighboring electrode G1. This parasitic capacitance is about some hundreds of picofarads. For efficient focusing of the X-ray image intensifier tube, it is desirable that the voltage Ug1 of the electrode G1 should be stable at about 1 V during the periods of operation of the X-ray image intensifier tube. While the X-ray image intensifier tube is off, the voltage Ug1 of the electrode G1 is of little importance. The supply source that gives the supply voltage to the electrode G1 has an output capacitor of the order of some tens of nanofarads. This output capacitor constitutes a capacitive voltage divider with the parasitic capacitance between the photocathode PC and the electrode G1. Consequently, a switch-over of the voltage Upc of the photocathode PC prompts a offsetting of the voltage Ug1 of the electrode G1. The variation of the voltage of the electrode ¯G1 and that of the voltage of the photocathode are in the same direction. The amplitude of the offset is about a hundred times lower than that of the variation of the voltage Upc of the photocathode PC.

Figure 4A:
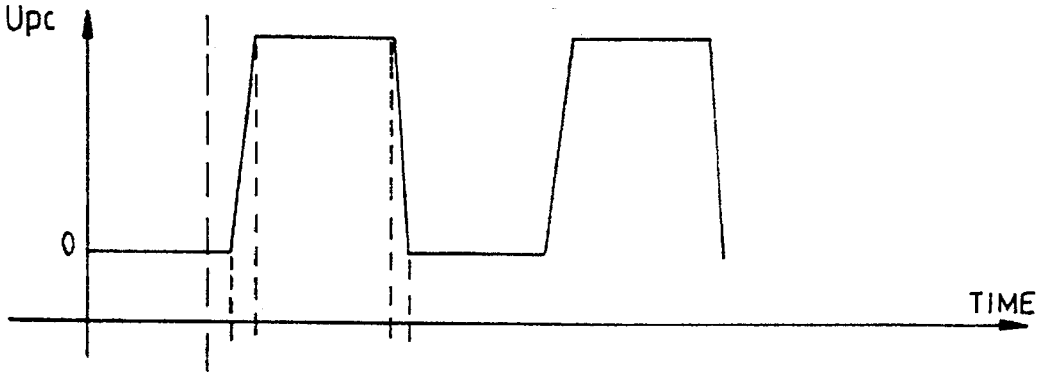
FIGS. 4*a*, 4*b*, 4*c* respectively give a view in time of the voltage of the photocathode, the voltage of the electrode G1 according to a known method of use, and the voltage of the electrode G1 according to the method of the invention.
Figure 4B:
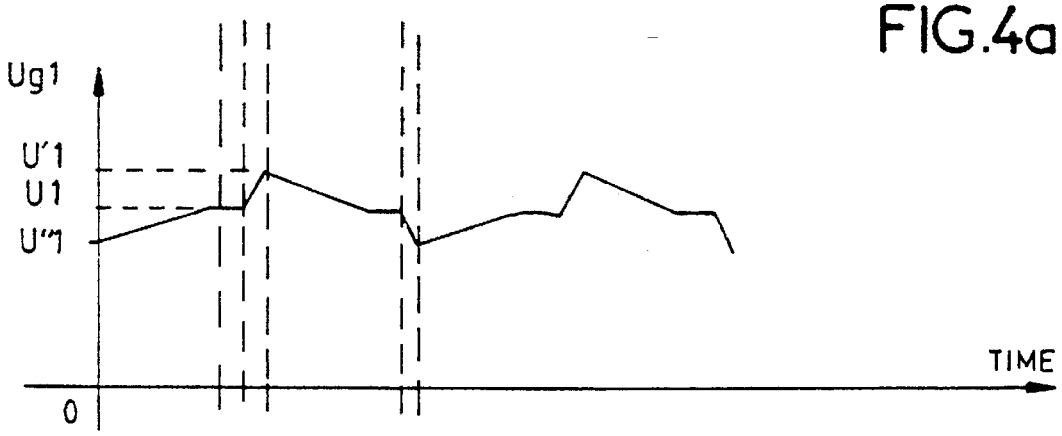

This is what is shown by the graph of FIG. 4*b* in relation with that of FIG. 4*a*.

Just before passing into the off state, at the instant to, the voltage Ug1 of the electrode G1 has the value U1 which is its nominal value. The switch-over of the voltage of the photocathode from 0 V to +1000 V prompts an increase in the voltage Ug1 of the electrode G1 to the value U'1=U1+ΔU1 with ΔU1 in the range of 10 V. So long as the voltage of the photocathode remains at +1000 V owing to the regulation of voltage of the electrode G1, the voltage of the electrode G1 decreases slowly to return to this nominal value U1. This takes a period of time of about several milliseconds.

During the switch-over of the voltage of the photocathode PC designed to place the X-ray image intensifier tube in the operating state, the voltage of the electrode G1 gets offset again, but in the other direction, and takes a value U"1= U1−ΔU1. Then the voltage Ug1 of the electrode G1 increases slowly to return to its nominal value U1. During this period of time (some milliseconds), the X-ray image intensifier tube is defocused and is not compatible with the use that is sought to be made of it. It is assumed that the voltage Ug1 of the electrode G1 recovers its nominal voltage U1 before a new switching operation aimed at turning the X-ray image intensifier tube off.

Figure 4C:
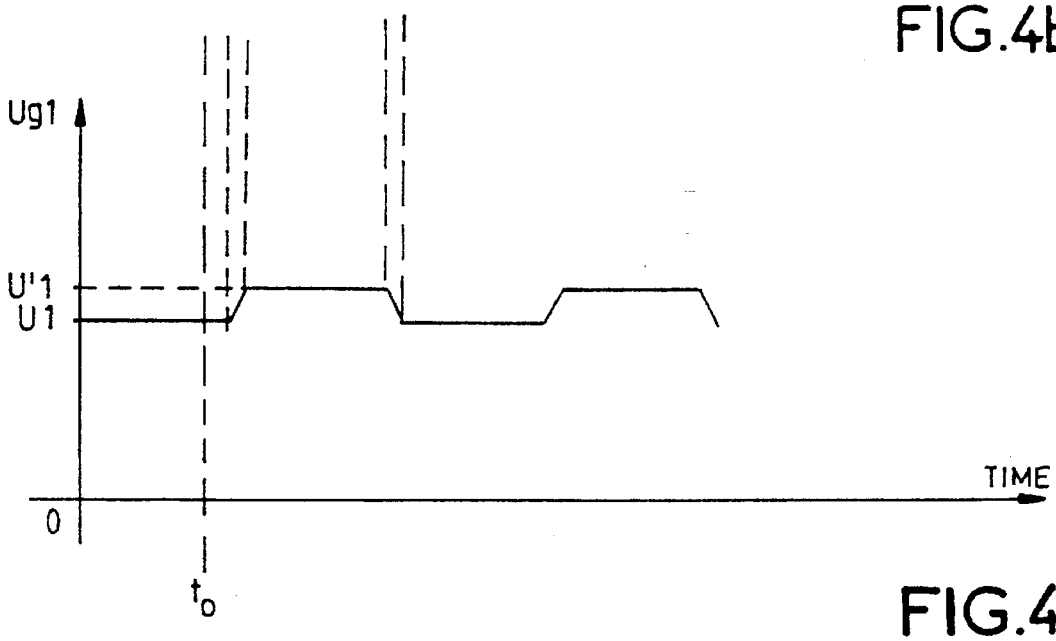

Reference may be made to FIG. 4*c*.

Instead of using a large decoupling capacitor or a complicated regulation circuit to stabilize the voltage Ug1 more speedily, the method according to the invention proposes the measurement of the value U'1 of the voltage Ug1 just after a passage into the off state. This value U'1 is greater than the nominal voltage U1. The method consists then in requiring the voltage of the electrode G1 to remain at this value U1 so long as the X-ray image intensifier tube is off. During the passage into the operating state, the voltage Ug1, in becoming offset, returns to its nominal value U1 by itself. It is enough to hold this nominal value U1 again on the electrode G1 to eliminate the defocusing.

Figure 5:
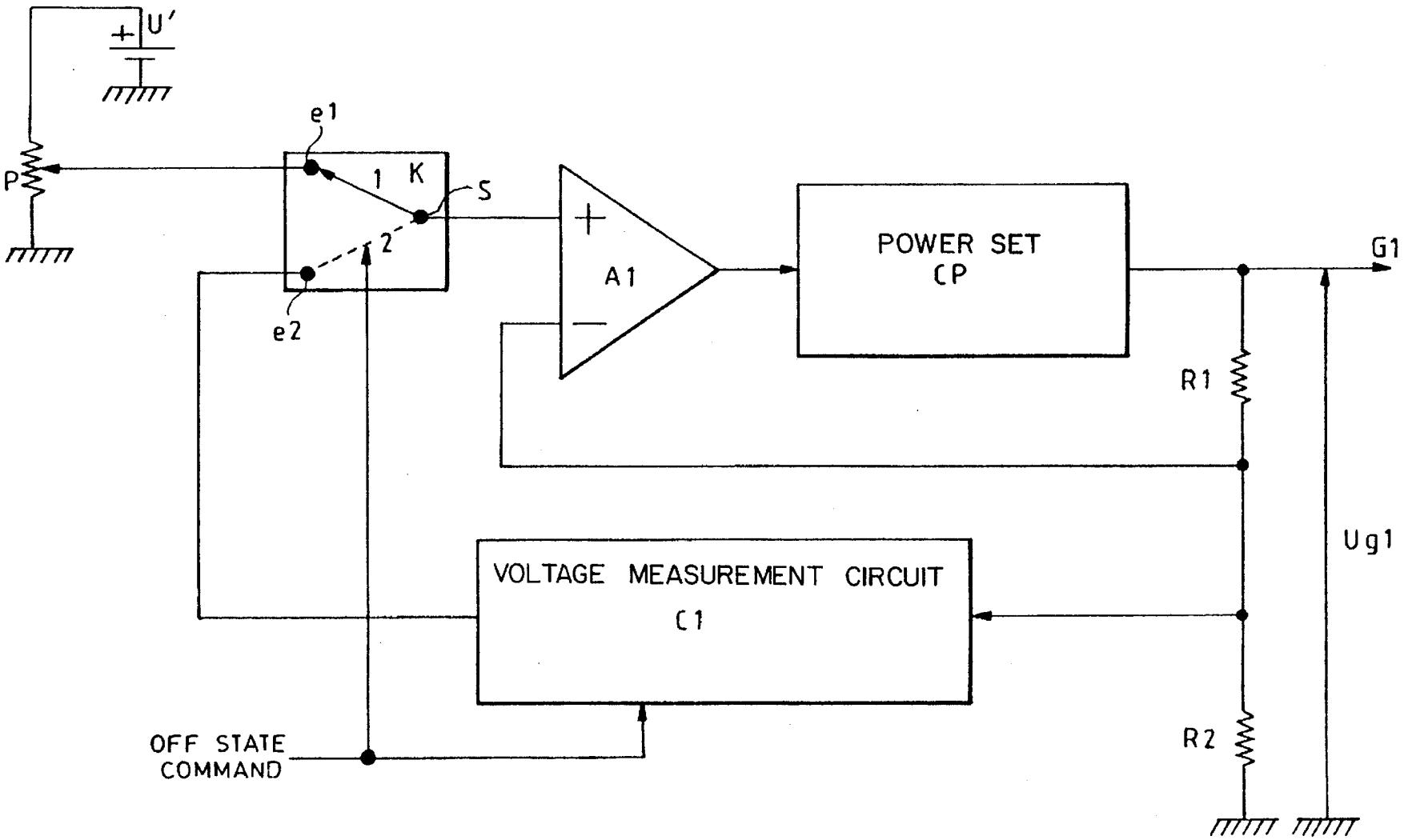
FIG. 5 exemplifies a circuit to stabilize the voltage of the electrode G1.

FIG. 5 illustrates a circuit for stabilizing the voltage of the electrode G1 with which the circuit may be provided for the implementation of the method according to the invention.

This circuit has a differential amplifier A1 whose output supplies the electrode G1. It may be advantageous to insert a power set PC between the output of the amplifier A1 and the electrode G1. This power set gives the supply voltage of the electrode G1 with appropriate power. It may be made with a transformer or a high-voltage transistor for example.

Two series-connected resistors R1, R2 form a divider bridge between the output of the power set CP and the ground. The resistor R1 is connected to the power set CP and the resistor R2 to the ground. It is possible, for example, to choose these resistors so that R1=99R2. This sets up a divider bridge with a ratio of 1/100. The voltage Ug1 applied to the electrode G1 is the one present at the terminals of the divider bridge.

The non-inverter input of the amplifier A1 is connected to the outputs of a change-over switch K with two inputs e1, e2.

The inverter input of the amplifier A1 is connected to the common point between the two resistors R1, R2 of the divider bridge. The amplifier A1 is mounted in a standard way as an error amplifier. The first input e1 of the change-over switch K is connected to a voltage reference U' by means of an adjusting potentiometer P. This reference U' gives the amplifier A1 a first instructed-value voltage designed to carry the voltage of the electrode G1 to its nominal value U1. This voltage reference could have been obtained by other means.

The second input e2 of the switch K is connected to a circuit C1 itself connected to the common point between the two resistors R1, R2 of the divider bridge.

This circuit C1 delivers a second instructed-value voltage at the input e2. This second instructed-value voltage imposes the offset value U'1 on the voltage Ug1 of the electrode G1 so long as the X-ray image intensifier tube is in the off state.

This circuit C1, in measuring the voltage Ur2 at the terminals of the register R2 just after the passage into the off state, determines the value of the second instructed-value voltage.

If R1=99R2 then:

$$Ur2=Ug1/100$$

$$Ur2=U'1/100$$

The switch K flips over to its position 2 when passing into the off state. The amplifier A1 receives the second instructed-value voltage and the electrode G1 is held at the voltage U'1.

When the X-ray image intensifier tube goes into the operating state, the voltage Ug1 itself returns to the nominal value U1, the change-over switch K flips over to its position 1 and the first instructed-value voltage imposes the nominal value U1 on the voltage Ug1 so long as there is no change in state.

Preferably, the MOS transistors of the switch-over circuit are sorted out in terms of leakage current so that this current is known and compatible with the circuit used to implement the method according to the invention. Preferably also, they are specified in terms of drain-source avalanche energy.

In the example shown in FIG. 2, the transistors are N channel type transistors. They could have been P channel type transistors provided that a negative gate-source voltage were applied to saturate them, instead of a positive one.

What is claimed is:

1. A method for the use of an x-ray image intensifier tube comprising a succession of electrodes, among them a photocathode, capable of having alternately an off state and an operating state, said method consisting of the application to the photocathode of a substantially zero operating voltage when the X-ray image intensifier tube is in the operating state, wherein a positive turning-off voltage greater than said substantially zero operating voltage is applied to the photocathode so that the X-ray image intensifier tube is in the off state and wherein, when the X-ray image intensifier tube is in the off state, there is imposed, on the voltage of a neighboring electrode capacitively coupled to the photocathode, a voltage offset with respect to the nominal value possessed by this voltage when the X-ray image intensifier tube is in the operating state so that, during the passage from the off state to the operating state, the voltage of the electrode rapidly resumes its nominal value.

2. A method according to claim 1, wherein the turning-off voltage is substantially +1000 V.

3. A method of use according to claim 1, wherein the current in the photocathode is determined by the measurement of a voltage proportional to said current, and wherein a capacitor is used to eliminate sudden peaks of said current appearing during the switch-over of the voltage of the photocathode.

4. A method according to claim 1, wherein the offset value is determined from a value taken by said voltage just after a passage into the off state.

5. A circuit for the implementation of the method according to claim 1, comprising a circuit to switch over the voltage of the photocathode comprising two MOS transistors mounted in "push-pull" mode, the source of one and the drain of the other being mounted at the terminals of a supply source, the photocathode being connected to the common point between these two transistors and optoelectronic means to turn the first transistor off and make the second transistor saturated when the X-ray image intensifier tube is in the off state so that the photocathode has a voltage equal to the turning-off voltage and to make the first transistor saturated and turn the second transistor off when the X-ray image intensifier tube is in the operating state so that the photocathode has a substantially zero voltage.

6. A circuit according to claim 5, wherein the optoelectronic means comprise one optocoupler per transistor comprising a trigger mounted between the gate and the source of the transistor, a light-emitting diode to activate the trigger and a logic circuit to control the state of the diodes as a function of the state of the X-ray image intensifier tube.

7. A circuit according to claim 5, wherein the transistors are N channel MOS transistors.

8. A circuit according to claim 5, wherein the photocathode is connected to the common point by an armored cable.

9. A circuit according to claim 5, comprising a circuit for determining the current in the photocathode comprising a parallel circuit formed by a capacitor connected in parallel with the combination of a diode and a resistor, said parallel circuit mounted between the source of the transistor connected to the supply source and the ground, the voltage at the terminals of the resistor being proportional to the current.

10. A circuit according to claim 5, comprising a circuit for the stabilization of the voltage of the electrode neighboring the photocathode, comprising an error amplifier:

whose output is connected to the electrode, whose non-inverter input-is connected to a change-over switch that is controlled as a function of the state of the X-ray image intensifier tube and that, in a first position, receives a first instructed-value voltage and that, in a second position, receives a second instructed-value voltage, whose inverter input is connected to the common point between the two resistors of a bridge of resistors mounted between the output of the amplifier and the ground, the first instructed-value voltage giving the voltage of the electrode its nominal value and the second instructed-value voltage giving this voltage its offset value.

11. A circuit according to claim 10, wherein the first instructed-value voltage is given by a reference voltage through an adjusting potentiometer.

12. A circuit according to claim 10, wherein the second instructed-value voltage is given by a circuit measuring, at input, a voltage proportional to the voltage of the electrode just after a passage of the X-ray image intensifier tube into the off state.

13. A circuit according to claim 12, wherein the circuit has its measuring input connected to the common point between the two resistors of the bridge of resistors.

14. A circuit according to claim 10, wherein a power set is inserted between the output of the error amplifier and the bridge of resistors.

15. A circuit according to claim 5, wherein the MOS transistors are selected as a junction of their leakage current.

16. A circuit according to claim 5, wherein the MOS transistors are selective as a junction of their drain-source avalanche energy.

* * * * *